US009387662B2

(12) United States Patent
Kusaka

(10) Patent No.: US 9,387,662 B2
(45) Date of Patent: Jul. 12, 2016

(54) INTAGLIO PRINTING PRESS

(75) Inventor: Akehiro Kusaka, Noda (JP)

(73) Assignee: KOMORI CORPORATION, Tokyo (JP)

( * ) Notice: Subject to any disclaimer, the term of this patent is extended or adjusted under 35 U.S.C. 154(b) by 881 days.

(21) Appl. No.: 11/836,002

(22) Filed: Aug. 8, 2007

(65) Prior Publication Data

US 2008/0034992 A1 Feb. 14, 2008

(30) Foreign Application Priority Data

Aug. 9, 2006 (JP) ..... 2006-216669

(51) Int. Cl.

| | |
|---|---|
| ***B41F 9/02*** | (2006.01) |
| ***B41F 21/10*** | (2006.01) |
| ***B41F 23/04*** | (2006.01) |
| ***B41F 31/30*** | (2006.01) |

(52) U.S. Cl.

CPC ..... *B41F 9/021* (2013.01); *B41F 21/108* (2013.01); *B41F 23/044* (2013.01); *B41F 31/302* (2013.01)

(58) Field of Classification Search

CPC ..... B41F 9/021; B41F 31/302; B41F 23/044; B41F 21/108

USPC ..... 101/152, 174, 183, 170, 479, 480, 230, 101/216, 218, 153

IPC ..... B41F 9/00, 9/18

See application file for complete search history.

(56) References Cited

U.S. PATENT DOCUMENTS

| | | | | |
|---|---|---|---|---|
| 3,625,145 | A * | 12/1971 | Heatley et al. | 101/142 |
| 4,188,883 | A | 2/1980 | Schone et al. | |
| 4,438,694 | A | 3/1984 | Parkins et al. | |
| 4,552,066 | A | 11/1985 | Giori et al. | |
| 4,584,939 | A | 4/1986 | Giori | |
| 4,794,856 | A | 1/1989 | Giori | |
| 5,042,378 | A | 8/1991 | Germann | |
| 5,715,749 | A | 2/1998 | Miller | |

(Continued)

FOREIGN PATENT DOCUMENTS

| | | | |
|---|---|---|---|
| CN | 85 1 06621 | A | 3/1987 |
| CN | 1039213 | A | 1/1990 |

(Continued)

OTHER PUBLICATIONS

Japanese Office Action issued in Japanese Patent Application No. 2006-216669 on Feb. 14, 2012.

(Continued)

*Primary Examiner* — Jennifer Simmons

(74) *Attorney, Agent, or Firm* — Birch, Stewart, Kolasch & Birch, LLP

(57) ABSTRACT

Provided is an intaglio printing press including: a gravure printing device, which performs gravure printing on one surface of a sheet of paper; dryers, which dry the one surface of the sheet of paper, on which gravure printing is performed by the gravure printing device; an intaglio printing device, which performs intaglio printing on the sheet of paper having been dried by the dryers; and a printing surface switching device, which transfers the sheet of paper from the gravure printing device to the intaglio printing device in a manner that a surface of the sheet of paper on which the intaglio printing device performs intaglio printing is switched between any one of the one surface and the other surface of the sheet of paper.

18 Claims, 8 Drawing Sheets

(56) References Cited

U.S. PATENT DOCUMENTS

| | | | | |
|---|---|---|---|---|
| 6,302,016 | B1 | 10/2001 | Fausto et al. | |
| 6,722,276 | B1 | 4/2004 | Helmstadter | |
| 2002/0000166 | A1* | 1/2002 | Nakamura | 101/230 |
| 2005/0028696 | A1* | 2/2005 | Price et al. | 101/335 |
| 2005/0211116 | A1* | 9/2005 | Kumagai | 101/157 |

FOREIGN PATENT DOCUMENTS

| | | | |
|---|---|---|---|
| CN | 1250719 | A | 4/2000 |
| EP | 0132857 | A1 | 2/1985 |
| EP | 0553779 | A1 | 8/1993 |
| EP | 1092537 | A2 | 4/2001 |
| EP | 1167031 | A1 | 1/2002 |
| EP | 1516728 | A1 | 3/2005 |
| EP | 1579993 | A2 | 9/2005 |
| EP | 1088654 | A1 | 4/2011 |
| FR | 2221280 | | 10/1974 |
| GB | 1304592 | A | 1/1973 |
| JP | 58-126159 | A | 7/1983 |
| JP | 61-32755 | A | 2/1986 |
| JP | 61-137768 | A | 6/1986 |
| JP | 62-268644 | A | 11/1987 |
| JP | 1-37272 | B2 | 8/1989 |
| JP | 02-072952 | A | 3/1990 |
| JP | 4-25 | B2 | 1/1992 |
| JP | 04-200766 | A | 7/1992 |
| JP | 6-41202 | B2 | 6/1994 |
| JP | 06-155711 | A | 6/1994 |
| JP | 11-028800 | A | 2/1999 |
| JP | 11-300924 | A | 11/1999 |
| JP | 2001-058388 | A | 3/2001 |
| JP | 2001-96713 | A | 4/2001 |
| JP | 2001-145995 | A | 5/2001 |
| JP | 2001-322243 | A | 11/2001 |
| JP | 2004-034641 | A | 2/2004 |
| JP | 2005-88450 | A | 4/2005 |

OTHER PUBLICATIONS

Japanese Office Action issued in Japanese Patent Application No. 2012-110199 on Aug. 28, 2012.

Japanese Office Action issued in Japanese Patent Application No. 2006-216669 on Sep. 20, 2011.

Kipphan, "Handbook of Print Media Technologies and Production Methods", Heidelberg, 2001, pp. 244-246 (5 pages total).

Opposition Memorandum for European Patent No. 1 866 811-B1, dated Jan. 23, 2015, 29 pages.

* cited by examiner

INTAGLIO PRINTING PRESS

BACKGROUND OF THE INVENTION

1. Field of the Invention

The present invention relates to an intaglio printing press, which can perform intaglio printing on both surfaces of a sheet in a single pass, and which also can perform intaglio printing on one surface of a sheet a plurality of times in a single pass.

2. Description of the Related Art

As a conventional intaglio printing press, for example, one as described in Japanese Patent Application Laid-open Publication No. 2001-096713 is known. When this intaglio printing press performs intaglio printing on both surfaces of a sheet of paper, intaglio printing is performed firstly on the back side of the sheet of paper. The sheet of paper is then left for several days, so that ink on the back side is dried. Thereafter, the sheet of paper is turned over, and is then fed to the intaglio printing press so that intaglio printing is performed on the top side of the sheet of paper again. After that, the sheet of paper is left for another several days, so that ink on the top side is dried.

In addition, a printing press which can perform intaglio printing and offset printing in a single pass is described in, for example, Japanese Examined Patent Publication No. Hei 4-000025. In this printing press, printing is performed on both surfaces of a sheet of paper by offset printing in the former stage. Subsequently, intaglio printing can be performed on one surface of the sheet of paper in the latter stage, after the sheet of paper is turned over if necessary.

Other related art include Examined Patent Publication No. Hei 1-037272, Japanese Examined Patent Publication No. Hei 6-041202, and Japanese Patent Application Laid-open Publication No. 2005-088450.

In the intaglio printing press disclosed in Japanese Patent Application Laid-open Publication No. 2001-096713 described above, it is not possible to perform intaglio printing on both surfaces of a sheet of paper in a single pass. Accordingly, there is a problem in which it takes time to complete intaglio printing on both surfaces of a sheet of paper, making large the workload on the operator.

On the other hand, the printing press disclosed in Japanese Examined Patent Publication No. Hei 4-000025 has the following problem. Specifically, while it is possible to perform intaglio printing and offset printing in a single pass, it is not possible to perform intaglio printing on both surfaces of a sheet of paper in a single pass, or to perform intaglio printing on one surface of a sheet a plurality of times in a single pass.

SUMMARY OF THE INVENTION

Accordingly, an object of the present invention is to provide an intaglio printing press, which can perform intaglio printing on both surfaces of a sheet in a single pass, and which also can perform intaglio printing on one surface of a sheet a plurality of times in a single pass.

For solving the above-described problem, the present invention provides an intaglio printing press characterized by including a first intaglio printing unit, first drying means, a second intaglio printing unit, and printing surface switching means. The first intaglio printing unit performs intaglio printing on one surface of a sheet. The first drying means dries the one surface of the sheet, on which intaglio printing is performed by the first intaglio printing unit. The second intaglio printing unit performs intaglio printing on the sheet having been dried by the first drying means. The printing surface switching means transfers the sheet from the first intaglio printing unit to the second intaglio printing unit in a manner that a surface of the sheet on which the second intaglio printing unit performs intaglio printing can be switched between any one of the one surface and the other surface of the sheet.

In addition, the intaglio printing press according to the present invention provides the following characteristic. In the intaglio printing press, at least one of the first intaglio printing unit and the second intaglio printing unit includes: an impression cylinder, which holds the sheet; an intaglio cylinder, which is in contact with the impression cylinder, and which performs printing on the sheet held by the impression cylinder; a pattern roller, which supplies ink to the intaglio cylinder; and an inking device, which is in contact with the pattern roller, and which supplies ink to the pattern roller.

In addition, the intaglio printing press according to an aspect of the present invention is characterized by further including an ink collecting cylinder, which is arranged between the intaglio cylinder and the pattern roller, and which is thus in contact with the intaglio cylinder and the pattern roller.

In addition, the intaglio printing press according to an aspect of the present invention is characterized in that the pattern roller is in contact with the intaglio cylinder.

In addition, the intaglio printing press according to the present invention provides the following characteristic. In the intaglio printing press, the inking device includes: an ink fountain, which stores ink; an ink fountain roller, which takes out the ink in the ink fountain from an edge of the ink fountain; and a roller, which is arranged so that the outer peripheral surface of the roller is located vertically below the position of the gap between the edge of the ink fountain and the ink fountain roller.

In addition, the intaglio printing press according to an aspect of the present invention is characterized in that the roller is in contact with the ink fountain roller.

In addition, the intaglio printing press according to an aspect of the present invention is characterized in that the roller is an oscillating roller.

In addition, the intaglio printing press according to an aspect of the present invention is characterized by further including supporting means, which supports the pattern roller and the inking device, and which can move in the axial direction of the pattern roller.

In addition, the intaglio printing press according to the present invention provides the following characteristic. In the intaglio printing press, the supporting means includes: an inker frame, which supports the pattern roller and the inking device, and which is provided with an engaging portion; and a main body frame, which is provided with an engaged portion engaged with the engaging portion of the inker frame.

In addition, the intaglio printing press according to the present invention provides the following characteristic. The engaging portion of the inker frame is a guide rail, while the engaged portion of the main body frame is a guide member supporting the guide rail in a manner that the guide rail can slidingly move. Moreover, the inker frame is supported on the main body frame in a manner that the inker frame is spaced apart from a floor when being positioned inside the printing press, while the inker frame is supported on the floor due to the deflection of the guide rail when being positioned outside the printing press.

In addition, the intaglio printing press according to an aspect of the present invention is characterized in that the printing surface switching means includes a convertible cylinder. The convertible cylinder grips the back edge portion of the sheet transported from the first intaglio printing unit with the forward edge portion of the sheet being held so as to transfer the sheet while turning over the sheet. Moreover, the convertible cylinder alternatively grips the forward edge portion of the sheet transported from the first intaglio printing unit with the forward edge portion of the sheet being held so as to transfer the sheet while not turning over the sheet.

In addition, the intaglio printing press according to the present invention provides the following characteristic. In the intaglio printing press, the printing surface switching means includes a transport cylinder, which is arranged upstream of the convertible cylinder in the transporting direction of the sheet in a manner that the transport cylinder faces the convertible cylinder, and which holds the forward edge portion of the sheet transported from the first intaglio printing unit so as to transfer the sheet to the convertible cylinder.

In addition, the intaglio printing press according to an aspect of the present invention is characterized in that the transport cylinder is a suction cylinder.

In addition, the intaglio printing press according to an aspect of the present invention is characterized in that the first drying means is arranged upstream, in the transporting direction of the sheet, of a portion where the printing surfaces are switched by the printing surface switching means.

In addition, the intaglio printing press according to the present invention provides the following characteristic. In the intaglio printing press, the first drying means is arranged to face the impression cylinder so that the first drying means can dry the one surface of the sheet, on which printing is performed between the impression cylinder and the intaglio cylinder of the first intaglio printing unit.

In addition, the intaglio printing press according to an aspect of the present invention is characterized by further including transporting means. The transporting means grips the sheet on which printing is performed between the impression cylinder and the intaglio cylinder of the first intaglio printing unit so as to transport the sheet. Moreover, the intaglio printing press according to an aspect of the present invention is also characterized in that the first drying means is arranged to face the transporting means so that the first drying means can dry the one surface of the sheet transported by the transporting means.

In addition, the intaglio printing press according to an aspect of the present invention is characterized in that at least one of the first intaglio printing unit and the second intaglio printing unit is a gravure printing device.

In addition, the intaglio printing press according to an aspect of the present invention is characterized in that one of the first intaglio printing unit and the second intaglio printing unit is a gravure printing device, and that the other one of the first intaglio printing unit and the second intaglio printing unit is an intaglio printing device.

BRIEF DESCRIPTION OF THE DRAWINGS

The present invention will become more fully understood from the detailed description given hereinbelow and the accompanying drawings which are given by way of illustration only, and thus are not limitative of the present invention and wherein;

FIG. 2A shows the schematic configurational view of the chief part in a phase state between a suction cylinder and a convertible cylinder at the time of both-side printing; FIG. 2B shows the schematic configurational view of the chief part in a phase state between the suction cylinder and the convertible cylinder at the time of one-side printing;

DETAILED DESCRIPTION OF THE INVENTION

Hereinafter, descriptions will be given of embodiments of an intaglio printing press according to the present invention with reference to the accompanied drawings. However, the present invention is not limited to the embodiments described below.

First Embodiment

Descriptions will be given below of a first embodiment of an intaglio printing press according to the present invention with reference to FIGS. 1 to 5.

Figure 1:
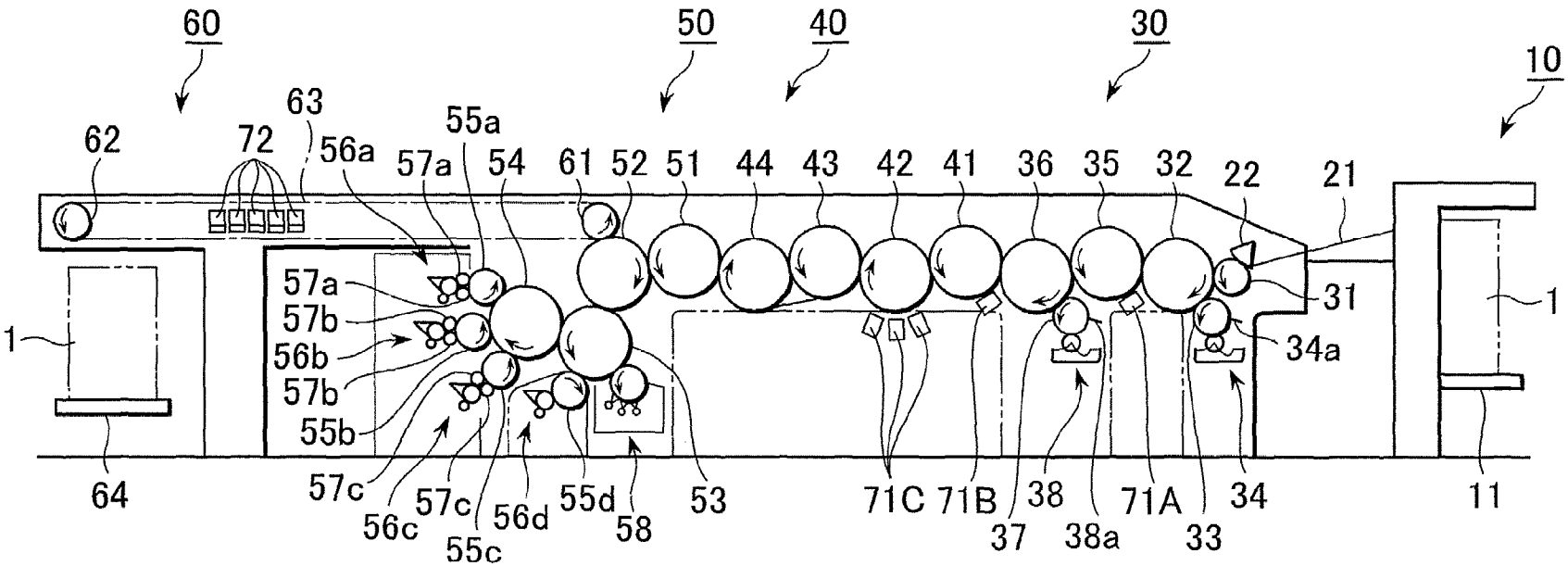
FIG. 1 shows a schematic configurational view of a first embodiment of an intaglio printing press according to the present invention.

As shown in FIG. 1, a feeder 10, which feeds sheets 1 of paper piled on a pile board 11 one by one, communicates to the proximal end of a feeding table 21. A swing arm shaft pregripper 22 is provided to the distal end of the feeding table 21. The swing arm shaft pregripper 22 transfers the sheets 1 to a transfer cylinder 31 of a gravure printing device 30 serving as a first intaglio printing unit.

A first impression cylinder 32 is in contact with the transfer cylinder 31 at a position downstream, in the transporting direction of the sheets 1 (hereinafter also referred to as the sheet transporting direction), of the position where the swing arm shaft pregripper 22 transfers the sheets 1 to the transfer cylinder 31. A first intaglio cylinder 33 is in contact with the first impression cylinder 32 at a position downstream, in the sheet transporting direction, of the position where the first impression cylinder 32 is in contact with the transfer cylinder 31. The first intaglio cylinder 33 is provided with a first inking device 34 for supplying ink to the first intaglio cylinder 33 and a first doctor 34*a* for scraping excess ink adhering on the surface of the first intaglio cylinder 33.

A transfer cylinder 35 is in contact with the first impression cylinder 32 at a position downstream, in the sheet transporting direction, of the position where the first impression cylinder 32 is in contact with the first intaglio cylinder 33. A second impression cylinder 36 is in contact with the transfer cylinder 35 at a position downstream, in the sheet transporting direction, of the position where the transfer cylinder 35 is in contact with the first impression cylinder 32. A second intaglio cylinder 37 is in contact with the second impression cylinder 36 at a position downstream, in the sheet transporting direction, of the position where the second impression cylinder 36 is in contact with the transfer cylinder 35. The second intaglio cylinder 37 is provided with a second inking device 38 for supplying ink to the second intaglio cylinder 37 and a second doctor 38*a* for scraping excess ink adhering on the surface of the second intaglio cylinder 37.

A printing surface switching device 40 is in contact with the second impression cylinder 36 with transfer cylinders 41 and 42 interposed in between at a position downstream, in the sheet transporting direction, of the position where the second impression cylinder 36 is in contact with the second intaglio cylinder 37. The printing surface switching device 40 serves as printing surface switching means, and includes a suction cylinder 43 and a convertible cylinder 44. The printing surface switching device 40 has, for example, a publicly known configuration as described in Japanese Examined Patent Publication No. Hei 6-041202 and Japanese Patent Application Laid-open Publication No. 2005-088450.

Figure 2A:
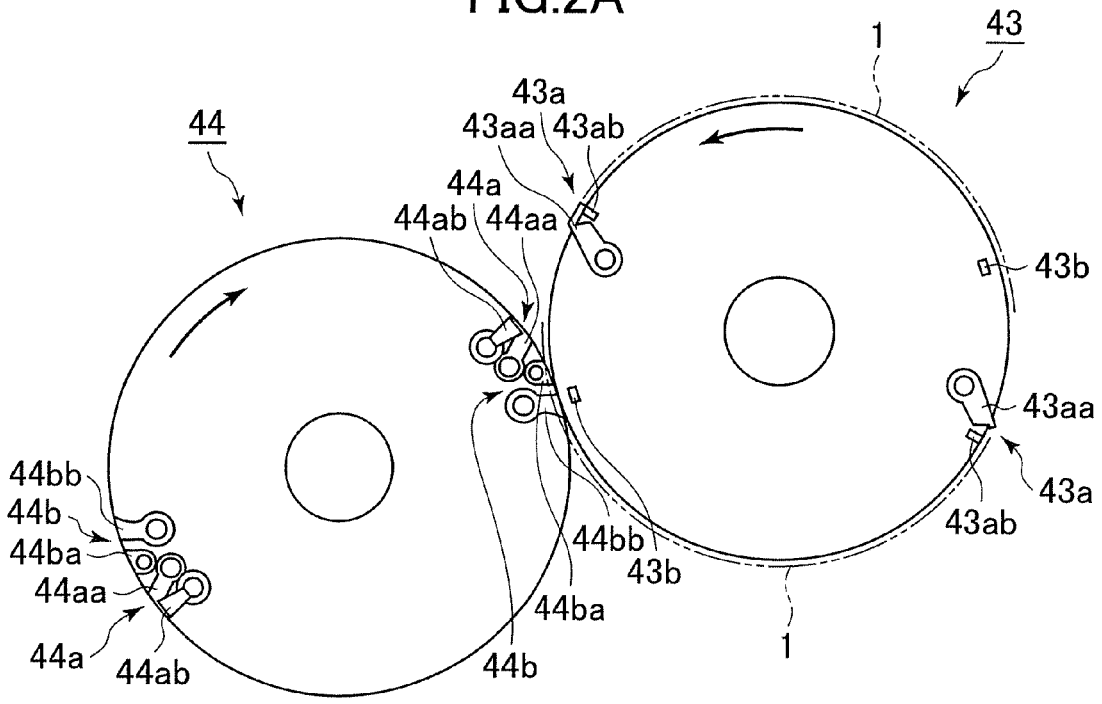
FIGS. 2A and 2B show schematic configurational views of a chief part of a printing surface switching device of the intaglio printing press of FIG. 1.
Figure 2B:
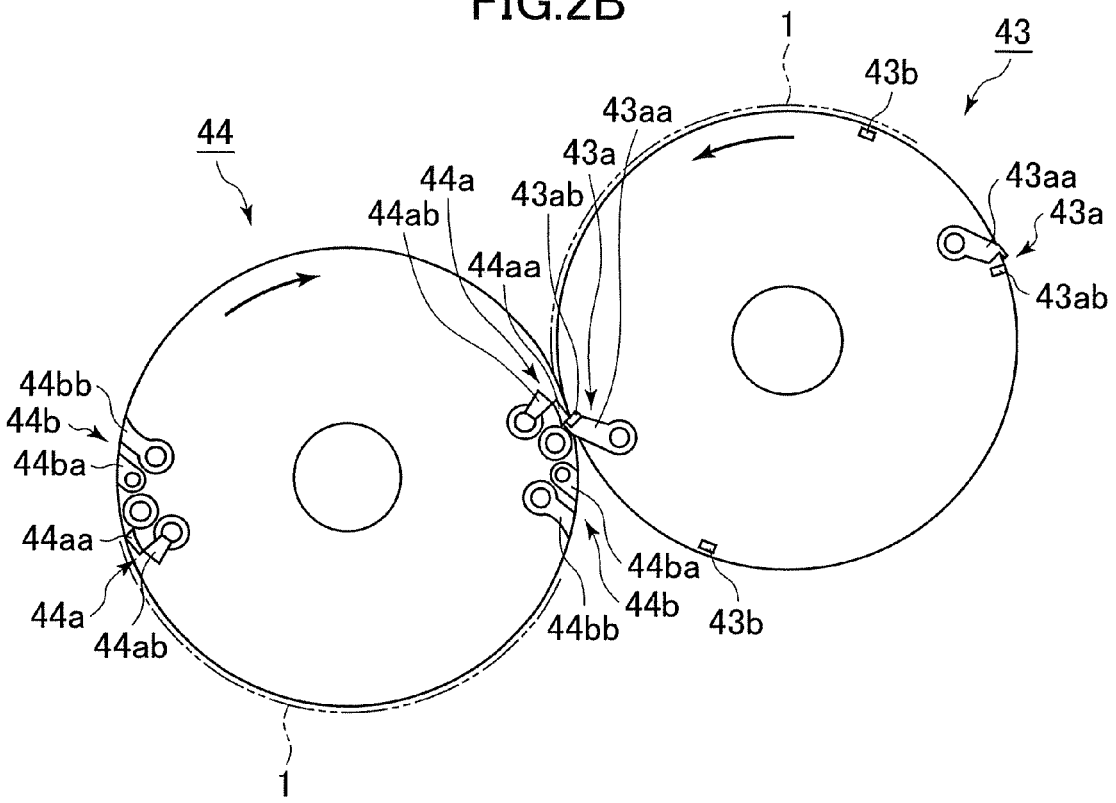

To be specific, as shown in FIGS. 2A and 2B, the suction cylinder 43, which is a transport cylinder, is in contact with the transfer cylinder 42 at a position downstream, in the sheet transporting direction, of the position where the transfer cylinder 42 is in contact with the transfer cylinder 41. The suction cylinder 43 is provided with a plurality of sets (two in this embodiment) of gripper devices 43*a* and suction heads 43*b* arranged at predetermined intervals in the circumferential direction of the suction cylinder 43. Each of the gripper devices 43*a* includes a gripper 43*aa* and a gripper pad 43*ab*. The convertible cylinder 44 is in contact with the suction cylinder 43 at a position downstream, in the sheet transporting direction, of the position where the suction cylinder 43 is in contact with the transfer cylinder 42. A plurality of sets (two in this embodiment) of first and second gripper devices 44*a* and 44*b* are adjacent to each other in the circumferential direction of the convertible cylinder 44 to be paired with each other, are provided in gap portions formed in the outer periphery of the convertible cylinder 44, and are arranged at predetermined intervals in the circumferential direction. Each of the first gripper devices 44*a* includes a gripper 44*aa* and a gripper pad 44*ab* while each of the second gripper devices 44*b* includes a gripper 44*ba*, and a gripper pad 44*bb*.

A transfer cylinder 51 of an intaglio printing device 50, which serves as a second intaglio printing unit, is in contact with the convertible cylinder 44 of the printing surface switching device 40. An impression cylinder 52 is in contact with the transfer cylinder 51 at a position downstream, in the sheet transporting direction, of the position where the transfer cylinder 51 is in contact with the convertible cylinder 44. An intaglio cylinder 53 is in contact with the impression cylinder 52 at a position downstream, in the sheet transporting direction, of the position where the impression cylinder 52 is in contact with the transfer cylinder 51.

An ink collecting cylinder 54 is in contact with the intaglio cylinder 53 at a position downstream, in the rotational direction of the intaglio cylinder 53, of the position where the intaglio cylinder 53 is in contact with the impression cylinder 52. A plurality of pattern rollers 55*a* to 55*c* (three rollers in this embodiment) are in contact with the ink collecting cylinder 54. A pattern roller 55*d* is in contact with the intaglio cylinder 53 at a position downstream, in the rotational direction of the intaglio cylinder 53, of the position where the intaglio cylinder 53 is in contact with the ink collecting cylinder 54. Inking devices 56*a* to 56*c* are provided respectively to the pattern rollers 55*a* to 55*c* with form rollers 57*a* to 57*c* in between, while an inking device 56*d* is provided to the pattern roller 55*d*.

Figure 3:
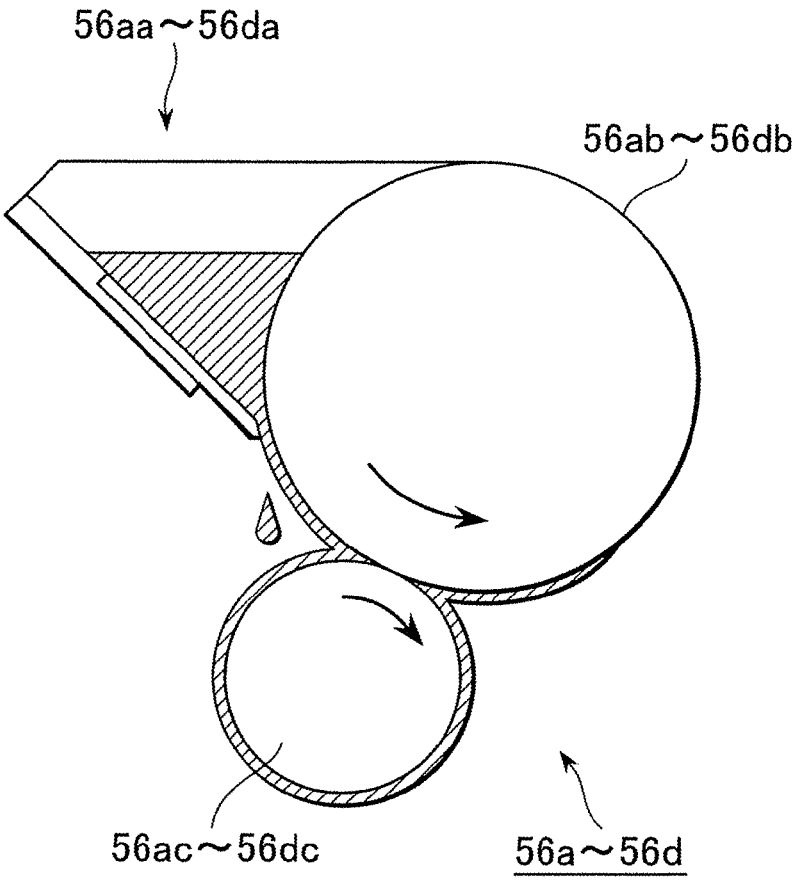
FIG. 3 shows an extracted and enlarged view of a chief part of an intaglio printing device of the intaglio printing press of FIG. 1.

The inking device 56*a* (56*b* to 56*d*) includes an ink fountain 56*aa* (56*ba* to 56*da*), an ink fountain roller 56*ab* (56*bb* to 56*db*) and an oscillating roller 56*ac* (56*bc* to 56*dc*), as shown in FIG. 3. The ink fountain 56*aa* (56*ba* to 56*da*) stores ink. The ink fountain roller 56*ab* (56*bb* to 56*db*) takes out ink in the ink fountain 56*aa* (56*ba* to 56*da*) from an edge of the ink fountain 56*aa* (56*ba* to 56*da*). The oscillating roller 56*ac* (56*bc* to 56*dc*) is a roller which is in contact with the ink fountain roller 56*ab* (56*bb* to 56*db*), and levels the ink taken out from the inside of the ink fountain 56*aa* (56*ba* to 56*da*) on the ink fountain roller 56*ab* (56*bb* to 56*db*) in the axial direction of the ink fountain roller 56*ab* (56*bb* to 56*db*). The oscillating roller 56*ac* (56*bc* to 56*dc*) is arranged so that the outer peripheral surface of the oscillating roller 56*ac* (56*bc* to 56*dc*) is located vertically below the position of the gap between the edge of a bottom plate of the ink fountain 56*aa* (56*ba* to 56*da*) and the ink fountain roller 56*ab* (56*bb* to 56*db*), that is, vertically below the position of the edge portion of the ink fountain 56*aa* (56*ba* to 56*da*).

As shown in FIG. 1, a wiping device 58 is provided to a position, downstream of the position where the intaglio cylinder 53 is in contact with the pattern roller 55*d*, and upstream of the position where the intaglio cylinder 53 is in contact with the impression cylinder 52, in the rotational direction of the intaglio cylinder 53. An unillustrated take-off cylinder of a delivery device 60 is in contact with the impression cylinder 52 at a position downstream, in the sheet transporting direction, of the position where the impression cylinder 52 is in contact with the intaglio cylinder 53.

Sprockets 61 paired with each other are provided, on the same axle, to the take-off cylinder. Endless chains 63 paired with each other are looped respectively around the sprockets 61. These chains 63 paired with each other are also looped respectively around sprockets 62 which are paired with each other and which are arranged above a pile board 64. A plurality of unillustrated gripper bars each gripping the sheet 1 are provided between the chains 63 paired with each other, and are arranged at predetermined intervals along the longitudinal direction of the chain 63.

A dryer 71A is arranged downstream of the position where the first impression cylinder 32 of the gravure printing device 30 is in contact with the first intaglio cylinder 33, and upstream of the position where the first impression cylinder 32 is in contact with the transfer cylinder 35, in the sheet transporting direction, in a manner that the dryer 71A faces the first impression cylinder 32. The dryer 71A dries ink printed on one surface of the sheet 1 transported from the first inking device 34 and the first intaglio cylinder 33.

A dryer 71B is arranged downstream of the position where the second impression cylinder 36 is in contact with the second intaglio cylinder 37, and upstream of the position where the second impression cylinder 36 is in contact with the transfer cylinder 41 of the printing surface switching device 40, in the sheet transporting direction, in a manner that the dryer 71B faces the second impression cylinder 36. The dryer 71B dries ink printed on that one surface of the sheet 1 transported from the second inking device 38 and the second intaglio cylinder 37.

Dryers 71C are arranged downstream of the position where the transfer cylinder 42 serving as transporting means of the printing surface switching device 40 is in contact with the transfer cylinder 41, and upstream of the position where the transfer cylinder 42 is in contact with the suction cylinder 43, in the sheet transporting direction, in a manner that the dryers 71C face the transfer cylinder 42. The dryers 71C finish drying ink printed on that one surface of the sheet 1 transported from the inking devices 34 and 38 as well as the intaglio cylinders 33 and 37.

In other words, the dryers 71A to 71C are arranged upstream, in the sheet transporting direction, of the suction cylinder 43 and the convertible cylinder 44 of the printing surface switching device 40, that is, upstream, in the sheet transporting direction, of the position where the printing surfaces are switched from one to the other by the printing surface switching device 40.

Each of dryers 72 is arranged between the sprockets 61 and 62 of the delivery device 60. The dryers 72 dry ink printed on that one surface or the other surface of the sheet 1 transported from the inking devices 56*a* to 56*d*, the pattern rollers 55*a* to 55*d*, the ink collecting cylinder 54 and the intaglio cylinder 53 of the intaglio printing device 50.

It should be noted that, in this embodiment, the dryers 71A to 71C and the like constitute first drying means while the dryers 72 and the like constitute second drying means.

Figure 4:
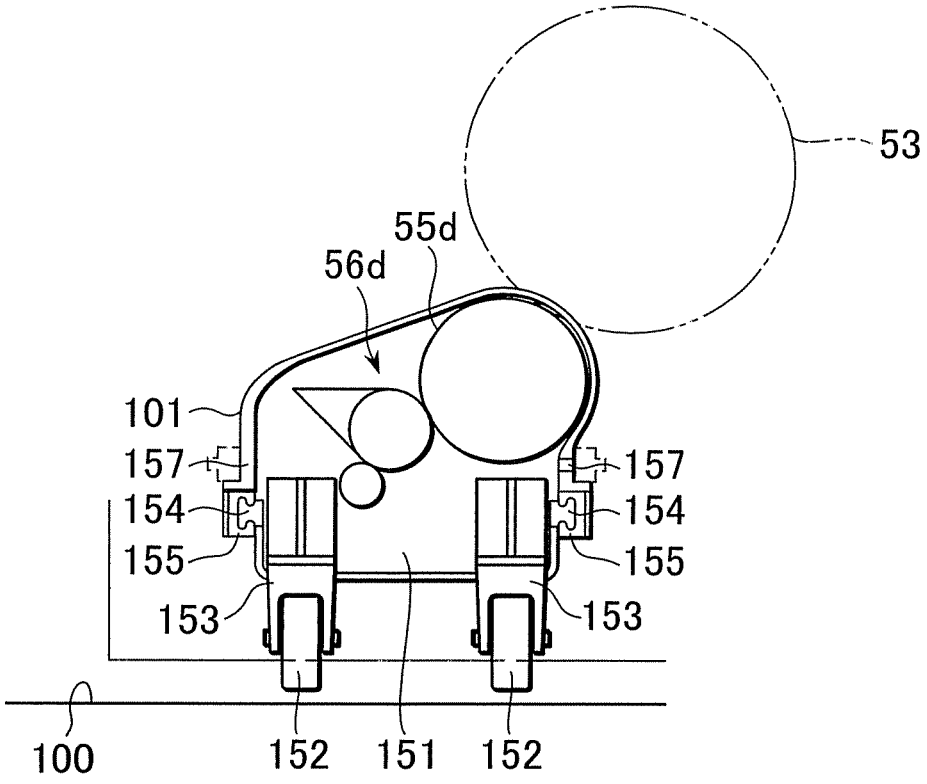
FIG. 4 shows an extracted and enlarged view of another chief part of the intaglio printing device of the intaglio printing press of FIG. 1.
Figure 5:
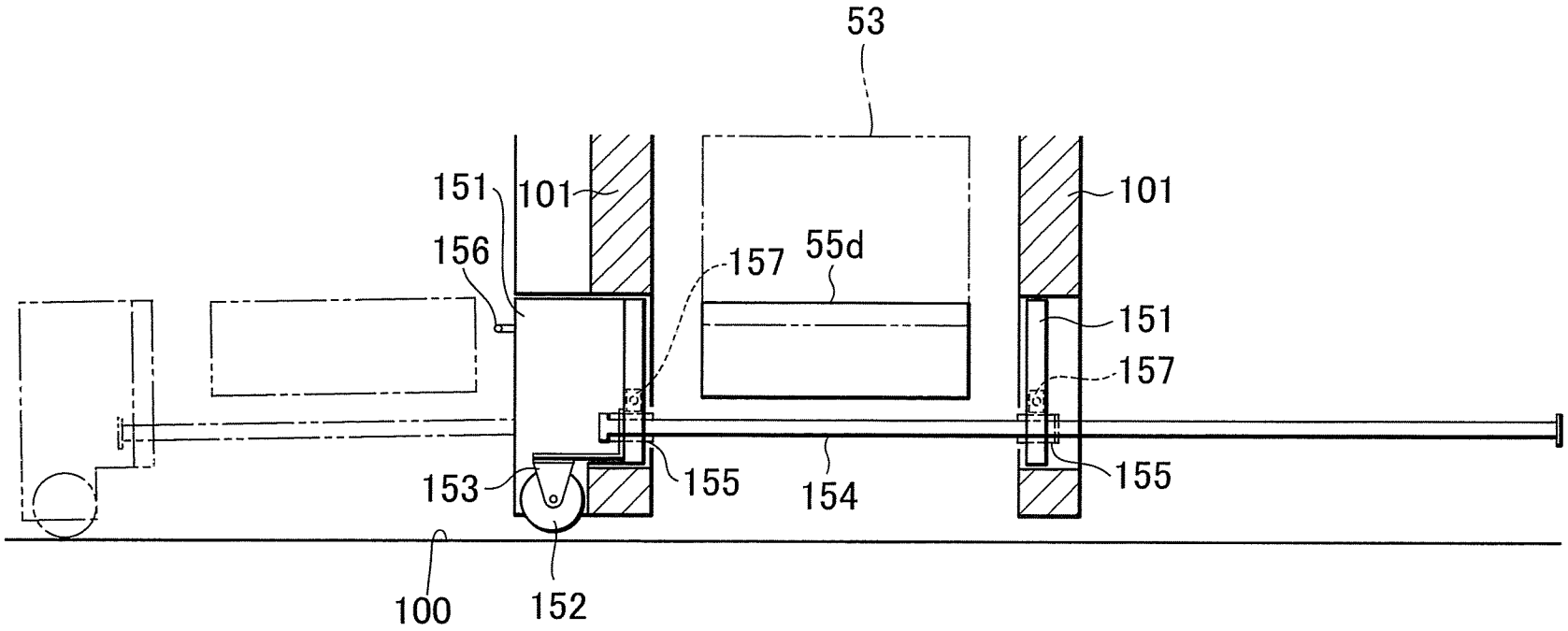
FIG. 5 shows a cross-sectional view of the part of FIG. 4, as viewed in the transporting direction of a sheet.

As shown in FIGS. 1, 4 and 5, an inker frame 151 is fitted into a main body frame 101 of an intaglio printing press, in a portion in a vicinity of the pattern roller 55*d* and the inking device 56*d* of the intaglio printing device 50. The inker frame 151 movably supports the pattern roller 55*d* and the inking device 56*d*. The inker frame 151 is fitted thereinto in a manner that the inker frame 151 moves along the horizontal direction perpendicular to the transporting direction of the sheets 1 with respect to the main body frame 101, that is, along the axial direction of the pattern roller 55*d*.

Guide rails 154, each having a substantially H-shaped cross section and serving as an engaging portion, are attached respectively to one side and the other side (the right and left sides in FIG. 4) of the inker frame 151 in the horizontal direction along the transporting direction of the sheets 1. The guide rails 154 are attached thereto also in a manner that the longitudinal direction of each guide rail 154 is aligned with the horizontal direction perpendicular to the transporting direction of the sheets 1, that is, with the axial direction of the pattern roller 55*d*. Each of the guide rails 154 extends so as to project to the outside of the inker frame 151 on the other side thereof (the right side in FIG. 5) in the horizontal direction perpendicular to the transporting direction of the sheets 1 for a length equal to or more than the length of the inker frame 151 in the horizontal direction. Each of the guide rails 154 can be deflected at a certain degree in the up-and-down direction.

Guide members 155, each having a substantially C-shaped cross section, are attached to the main body frame 101 respectively in vicinities of the corresponding guide rails 154. The guide members 155 serve as engaged portions, and are engaged respectively with the guide rails 154 in a manner that the guide members 155 hold the respective guide rails 154 so as to allow the guide rails 154 to slide in the longitudinal direction. A handle 156 is attached to one side (the left side in FIG. 5) of the inker frame 151 in the horizontal direction perpendicular to the transporting direction of the sheets 1.

A pair of wheels 152 are attached to that one side (the left side in FIG. 5) of the inker frame 151 in the horizontal direction perpendicular to the transporting direction of the sheets 1 with brackets 153 in a manner that the wheels 152 are spaced apart at a predetermined distance from a floor 100 where the intaglio printing press is placed. Each of the wheels 152 can roll in the horizontal direction.

The inker frame 151 is movably supported on the main body frame 101 with the guide rails 154 and the guide members 155 in a state the wheels 152 are spaced apart from the floor 100 when housed inside the main body frame 101, that is, when positioned in the printing press. By pulling the handle 156 toward that one side in the horizontal direction perpendicular to the transporting direction of the sheet 1, the inker frame 151 is pulled out toward that one side in the horizontal direction perpendicular to the transporting direction of the sheet 1 while the guide rails 154 are guided by the guide members 155. Once the inker frame 151 is positioned at the outside of the printing press, the guide rails 154 are deflected due to the weight of the inker frame 151, so that the wheels 152 are brought into contact with the floor 100. As a result, the inker frame 151 is movably supported on the floor 100 with the wheels 152 and the brackets 153. Accordingly, it is possible to pull out the inker frame 151 in the horizontal direction perpendicular to the transporting direction of the sheet 1 while the wheels 152 are caused to roll with respect to the floor 100, thus bringing out the pattern roller 55*d* and the inking device 56*d* to the outside of the main body frame 101.

Stoppers 157 are provided to the main body frame 101 respectively in vicinities of the inker frame 151. Each of the stoppers 157 is formed of an actuator, which detachably engages with the inker frame 151, and the like. In other words, the inker frame 151 is prevented from moving by the stoppers 157 engaging with the inker frame 151 when fitted into the main body frame 101. Disengaging the stoppers 157 from the inker frame 151 allows the inker frame 151 to move.

It should be noted that, in this embodiment, the main body frame 101, the inker frame 151, the wheels 152, the brackets 153, the guide rails 154, the guide members 155, the handle 156, the stoppers 157 and the like constitute supporting means.

Descriptions will be given next of the operation of the intaglio printing press according to the embodiment described above.

The sheet 1 is firstly fed one by one onto the feeding table 21 from the top of the pile board 11 of the feeder 10, and is transferred to the transfer cylinder 31 of the gravure printing device 30 by the swing arm shaft pregripper 22. The sheet 1 is then transferred from the transfer cylinder 31 to the first impression cylinder 32, so that gravure printing is performed on a first surface of the sheet 1 with ink supplied from the first inking device 34 to the first intaglio cylinder 33. After the ink thus formed on the first surface by the gravure printing is dried by the dryer 71A, the sheet 1 is transferred to the second intaglio cylinder 36 via the transfer cylinder 35, so that the gravure printing is further performed on the first surface with ink supplied from the second inking device 38 to the second intaglio cylinder 37. After that, the ink further formed on the first surface by the gravure printing is dried by the dryer 71B, and the sheet 1 is transferred to the transfer cylinders 41 and 42 of the printing surface switching device 40 to be transported.

When both-side printing is performed on the sheet 1, the sheet 1 transported from the transfer cylinders 41 and 42 is transferred from the suction cylinder 43 to the convertible cylinder 44 to change the gripper thereof while the first and second surfaces of the sheet 1 are turned over. The sheet 1 is consequently transferred to the transfer cylinder 51 of the intaglio printing device 50 (refer to Japanese Examined Patent Publication No. Hei 6-041202 and Japanese Patent Application Laid-open Publication No. 2005-088450 regarding the detailed turn-over operation).

Specifically, as shown in FIG. 2A, the phases of the suction cylinder 43 and the like are adjusted with respect to the phase of the convertible cylinder 44 so that the suction head 43*b* of the suction cylinder 43 meets the second gripper device 44*b* of the convertible cylinder 44. The sheet 1 having printed on the first surface thereof is transported in a state where the forward edge portion of the sheet 1 is gripped by the gripper device 43*a* of the suction cylinder 43 while the back edge portion thereof is sucked and held by the suction head 43*b*. Then, the opening and closing of the second gripper device 44*b* of the convertible cylinder 44 and the releasing of the suction of the suction head 43*b* of the suction cylinder 43 cause the back edge portion of the sheet 1 to be passed to, and thus be gripped by, the second gripper device 44*b* of the convertible cylinder 44. At the same time, the opening and closing of the gripper device 43*a* of the suction cylinder 43 cause the forward edge portion of the sheet 1 to be released. Accordingly, the sheet 1 is transferred to the convertible cylinder 44 in a manner that the back edge portion of the sheet 1 precedes the forward edge portion thereof. Subsequently, the corresponding first and second gripper devices 44*a* and 44*b* of the convertible cylinder 44 open and close at timings slightly different from each other, so that the sheet 1 is passed from the second gripper device 44*b* to the first gripper device 44*a* to be gripped by the first gripper device 44*a*. As a result, the first and second surfaces of the sheet 1 are turned over, so that the printing surfaces are switched.

The sheet 1 having the printed surface switched as described above is transferred from the transfer cylinder 51 to the impression cylinder 52. Then, the intaglio printing is performed on the second surface of the sheet 1 with ink supplied to the intaglio cylinder 53 from the inking devices 56*a* to 56*c* via the pattern rollers 55*a* to 55*c* and the ink collecting cylinder 54 as well as with ink supplied to the intaglio cylinder 53 from the inking device 56*d* via the pattern roller 55*d*. Thereafter, the sheet 1 is transferred to the take-off cylinder of the delivery device 60, and is then gripped by the gripper bar. Then, while the sheet 1 is transported by the chain 63 traveling in association with the rotations of the sprockets 61 and 62, the ink formed on the second surface by the intaglio printing is dried by the dryer 72, and the sheet 1 is consequently delivered onto the pile board 64.

On the other hand, when one-side printing is performed on the sheet 1, the sheet 1 transported from the transfer cylinders 41 and 42 is transferred from the suction cylinder 43 to the convertible cylinder 44 to be gripped while the first and second surfaces of the sheet 1 are not turned over. Then, the sheet 1 is transferred to the transfer cylinder 51 of the intaglio printing device 50.

Specifically, as shown in FIG. 2B, the phases of the suction cylinder 43 and the like are adjusted with respect to the phase of the convertible cylinder 44 so that the gripper device 43*a* of the suction cylinder 43 meets the first gripper device 44*a* of the convertible cylinder 44. The sheet 1 having printed on the first surface thereof is transported while the forward edge portion of the sheet 1 is gripped by the gripper device 43*a* of the suction cylinder 43. The opening and closing of the first gripper device 44*a* of the convertible cylinder 44, and the opening and closing of the gripper device 43*a* of the suction cylinder 43 cause the forward edge portion to be passed to, and then gripped by the first gripper device 44*a*. Accordingly, the sheet 1 is transferred to the convertible cylinder 44 in a manner that the forward edge portion precedes the back edge portion as it is. As a result, the sheet 1 is transported as it is without the switching of the printing surface.

After that, the sheet 1 is transferred from the transfer cylinder 51 to the impression cylinder 52. Then, the intaglio printing is performed on the first surface of the sheet 1 with ink supplied to the intaglio cylinder 53 from the inking devices 56*a* to 56*c* via the pattern rollers 55*a* to 55*c* and the ink collecting cylinder 54 as well as with ink supplied to the intaglio cylinder 53 from the inking device 56*d* via the pattern roller 55*d*. Thereafter, the sheet 1 is transferred to the take-off cylinder of the delivery device 60, and is then gripped by the gripper bar. Then, while the sheet 1 is transported by the chain 63 traveling in association with the rotations of the sprockets 61 and 62, the ink formed on the first surface by the intaglio printing is dried by the dryer 72, and the sheet 1 is consequently delivered onto the pile board 64.

As described above, the intaglio printing press according to this embodiment makes it possible to perform gravure printing on one surface of the sheet 1 while performing intaglio printing on the other surface of the sheet, in a single pass of the sheet 1. In other words, it is possible to perform intaglio printing on both surfaces of the sheet 1 at once. In addition, it is also possible to perform gravure printing and intaglio printing on one surface of the sheet 1 in a single pass. In other words, it is possible to perform intaglio printing on one surface of the sheet 1 a plurality of times at once.

The oscillating roller 56*ac* (56*bc* to 56*dc*) of the inking device 56*a* (56*b* to 56*d*) of the intaglio printing device 50 is arranged in a manner that the outer peripheral surface of the oscillating roller 56*ac* (56*bc* to 56*dc*) is located vertically below the position of the gap between the edge of the bottom plate of the ink fountain 56*aa* (56*ba* to 56*da*) and the ink fountain roller 56*ab* (56*bb* to 56*db*), that is, vertically below the position of the edge portion of the ink fountain 56*aa* (56*ba* to 56*da*). Accordingly, ink dropped off the gap is received by the outer peripheral surface of the oscillating roller 56*ac* (56*bc* to 56*dc*), and is thus applied to the outer peripheral surface of the ink fountain roller 56*ab* (56*bb* to 56*db*). This makes it possible to suppress the smearing of the lower side of the inking device 56*a* (56*b* to 56*d*), and to greatly reduce the time and effort on the maintenance and the like.

In addition, it is possible to move the inker frame 151 in a manner that the movement of the inker frame 151 is guided with the guide rails 154 and the guide members 155 while the inker frame 151 is movably supported on the floor 100 with the wheels 152 and the brackets 153 in between. Accordingly, it is possible to easily remove the pattern roller 55*d* and the inking device 56*d* with heavy loads out of the main body frame 101 by pulling the inker frame 151 from the main body frame 101. This allows the maintenance of the pattern roller 55*d* and the inking device 56*d* to be easily performed.

Moreover, the inker frame 151 is movably supported on the main body frame 101 with the guide rails 154 and the guide members 155 in between without being in contact with the floor 100. Accordingly, it is possible to securely bring the pattern roller 55*d* into contact with the intaglio cylinder 53 at a predetermined position at any time with accuracy, even in a case where the floor 100 has a step, where the wheels 152 are abraded, or where there is an object between the floor 100 and any one of the wheels 152. This makes it possible to securely prevent misprinting from occurring.

Second Embodiment

Figure 6:
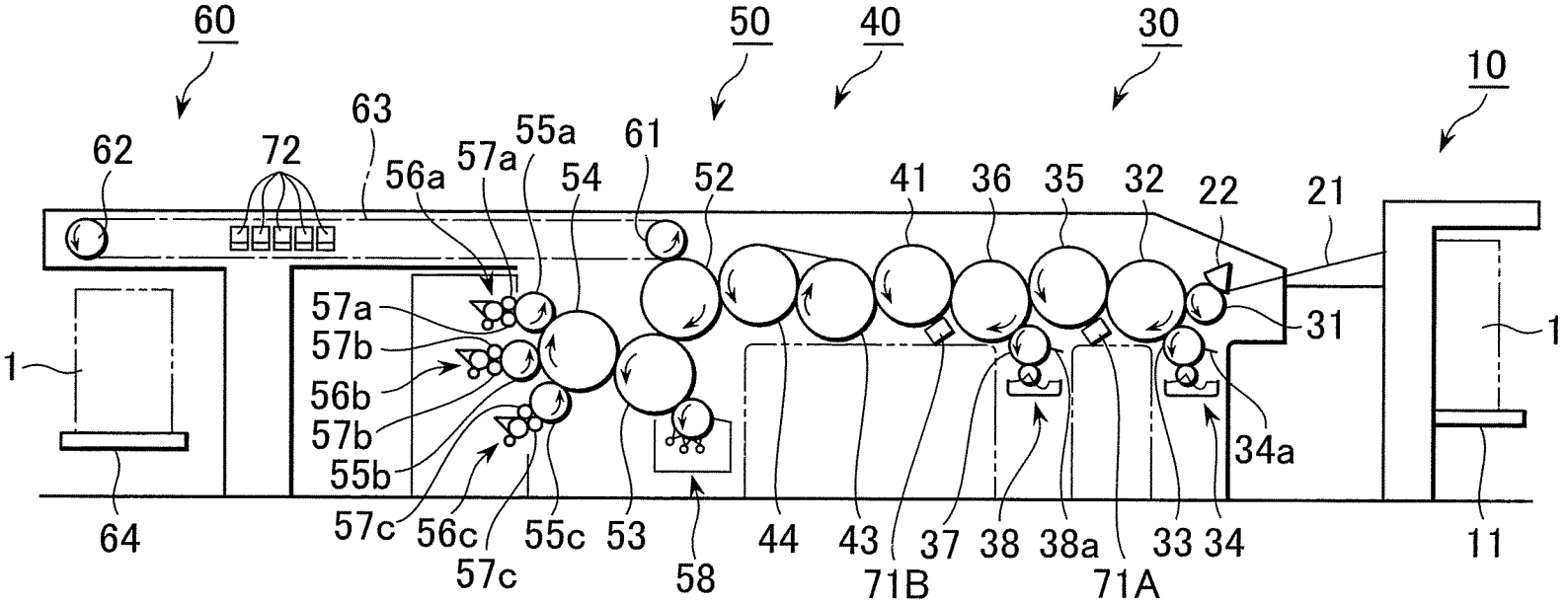
FIG. 6 shows a schematic configurational view of a second embodiment of the intaglio printing press according to the present invention.

In the above-described first embodiment, the intaglio printing press configured as follows has been described. Specifically, in the intaglio printing press, the intaglio printing device 50, which is provided with the inking device 56*d* and the pattern roller 55*d* in direct contact with the intaglio cylinder 53, and which communicates with the convertible cylinder 44 of the printing surface switching device 40 with the transfer cylinder 51 in between is employed as the second intaglio printing unit. In addition, in the intaglio printing press, the transfer cylinder 42, in a vicinity of which the dryer 71C is arranged, is positioned between the transfer cylinder 41 and the suction cylinder 43 of the printing surface switching device 40. However, an intaglio printing press having the following configuration as shown in FIG. 6 is also possible as a second embodiment. Specifically, the intaglio printing device 50, in which the inking device 56*d* and the pattern roller 55*d* in direct contact with the intaglio cylinder 53, are omitted, is employed as the second intaglio printing unit. In addition, the transfer cylinder 42 and the dryer 71C are omitted, so that the transfer cylinder 41 and the suction cylinder 43 of the printing surface switching device 40 are brought into direct contact with each other. Moreover, the transfer cylinder 51 of the intaglio printing device 50 is omitted, so that the impression cylinder 52 and the convertible cylinder 44 of the printing surface switching device 40 are brought into direct contact with each other.

Third Embodiment

Figure 7:
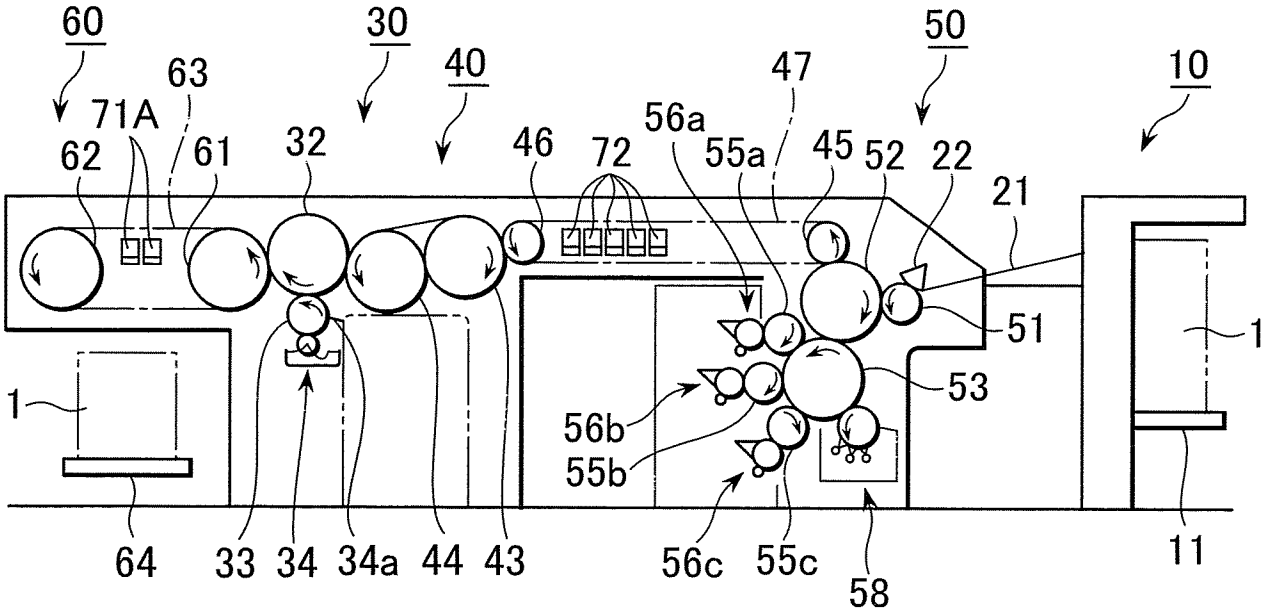
FIG. 7 shows a schematic configurational view of a third embodiment of the intaglio printing press according to the present invention.

In the above-described second embodiment, the intaglio printing press configured as follows has been described. Specifically, in the intaglio printing press, the gravure printing device 30 provided with a plurality of the impression cylinders 32 and 36, the intaglio cylinders 33 and 37, the inking devices 34 and 38, the doctor 34*a* and 38*a*, and the like, is employed as the first intaglio printing unit. In addition, the intaglio printing device 50, in which ink is supplied to the intaglio cylinder 53 from the pattern rollers 55*a* to 55*c* via the ink collecting cylinder 54, is employed as the second intaglio printing unit. Moreover, the transfer cylinders 41 and 42 are placed so as to communicate between the second impression cylinder 36 of the gravure printing device 30 and the suction cylinder 43 of the printing surface switching device 40. However, for example, an intaglio printing press having the following configuration as shown in FIG. 7 is also possible as a third embodiment. Specifically, the intaglio printing device 50, in which the ink collecting cylinder 54 and the form rollers 57*a* to 57*c* are omitted, and in which ink is thus supplied directly to the intaglio cylinder 53 from the pattern rollers 55*a* to 55*c*, is employed as the first intaglio printing unit. In addition, the gravure printing device 30, in which the second members 36, 37, 38 and 38*a* and the transfer cylinders 31 and 35 are omitted except the first members 32, 33, 34 and 34*a*, is employed as the second intaglio printing unit. Moreover, the impression cylinder 52 of the intaglio printing device 50 is configured to communicate to the suction cylinder 43 of the printing surface switching device 40 with the take-off cylinder of the delivery device 60, the sprockets 61 and 62, the chain 63, a take-off cylinder (not shown) having a configuration similar to the gripper bar or the like, the sprockets 45 and 46, the chain 47, the gripper bar (not shown) and the like, instead of the transfer cylinder 41.

Fourth Embodiment

Figure 8:
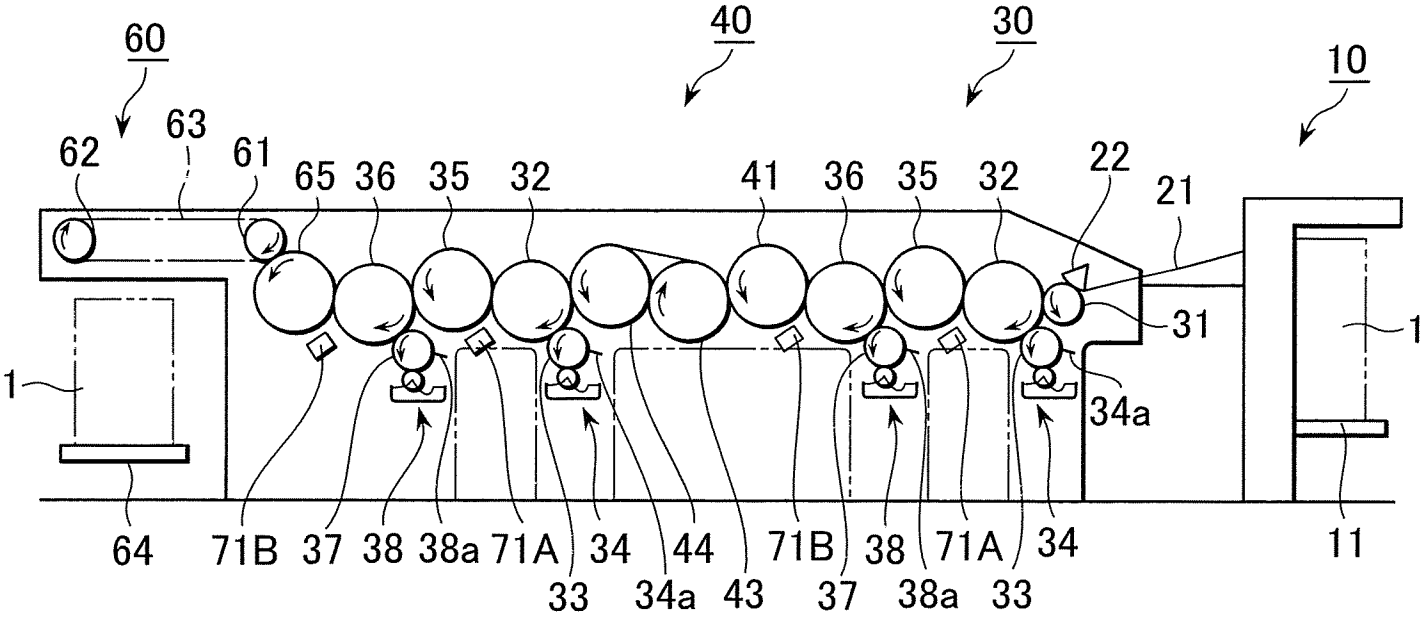
FIG. 8 shows a schematic configurational view of a fourth embodiment of the intaglio printing press according to the present invention.

Moreover, in the above-described first and second embodiments, descriptions have been given of the case where different kinds of intaglio printing methods are combined with each other. However, for example, as a fourth embodiment, it is also possible to employ the gravure printing device 30 as an intaglio printing press which employs both of the first intaglio printing unit and the second intaglio printing unit, as shown in FIG. 8. Incidentally, reference numeral 65 in FIG. 8 denotes a transfer cylinder.

Other Embodiments

In the above-described first embodiment, the inker frame 151 of the intaglio printing device 50 is configured to be manually moved with the handle 156. However, the following configurations are also possible as other embodiments. The inker frame 151 may be configured to be automatically moved by using a hydraulic cylinder, an air cylinder, a rack and a pinion along with an electric motor, or the like, instead of the handle 156.

Furthermore, in terms of the diameter of each of the above-described various cylinders, each cylinder may be appropriately selected as necessary, from a single cylinder having a diameter corresponding to the size of a single sheet, to multiple cylinders having a diameter corresponding to the total size of several sheets.

In the intaglio printing press according to the present invention, the printing surface of a sheet on which the second intaglio printing unit performs intaglio printing is switched by the printing surface switching means. Accordingly, it is possible to perform intaglio printing on both surfaces of a sheet in a single pass, and also to perform intaglio printing on one surface of a sheet a plurality of times in a single pass.

The intaglio printing press according to the present invention can perform intaglio printing on both surfaces of a sheet in a single pass, and can also perform intaglio printing on one surface of a sheet a plurality of times in a single pass. For this reason, the intaglio printing press according to the present invention is extremely beneficial to be used in the printing industry.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intaglio printing press, comprising:

a first intaglio printing unit, which performs intaglio printing on one surface of a sheet;

first drying means, which dries said one surface of the sheet, on which intaglio printing is performed by the first intaglio printing unit;

a second intaglio printing unit, which performs intaglio printing on the sheet having been dried by the first drying means; and printing surface switching means, which transfers the sheet from the first intaglio printing unit to the second intaglio printing unit in a manner that a surface of the sheet on which the second intaglio printing unit performs intaglio printing can be switched between any one of said one surface and the other surface of the sheet, wherein each of the first intaglio printing unit and the second intaglio printing unit includes, an impression cylinder, which holds the sheet, an intaglio cylinder, which is in direct contact with the impression cylinder, and which performs printing on the sheet held by the impression cylinder, an inking device, which supplies ink to the intaglio cylinder, and any one of a doctor and a wiping device, which removes excess ink adhering on a surface of the intaglio cylinder, and wherein the impression cylinder of the first intaglio printing unit and the impression cylinder of the second intaglio printing unit are connected only through cylinders.

2. The intaglio printing press according to claim 1 wherein at least one of the first intaglio printing unit and the second intaglio printing unit includes a pattern roller, which is arranged between the intaglio cylinder and the inking device, and which supplies ink from the inking device to the intaglio cylinder.

3. The intaglio printing press according to claim 2, further comprising:

an ink collecting cylinder, which is arranged between the intaglio cylinder and the pattern roller, and which is thus in contact with the intaglio cylinder and the pattern roller.

4. The intaglio printing press according to claim 2 wherein the pattern roller is in contact with the intaglio cylinder.

5. The intaglio printing press according to claim 2 wherein the inking device includes:

an ink fountain, which stores ink;

an ink fountain roller, which takes out the ink in the ink fountain from an edge of the ink fountain; and a roller, which is arranged so that the outer peripheral surface of the roller is located vertically below the position of the gap between the edge of the ink fountain and the ink fountain roller.

6. The intaglio printing press according to claim 5 wherein the roller is in contact with the ink fountain roller.

7. The intaglio printing press according to claim 6 wherein the roller is an oscillating roller.

8. The intaglio printing press according to claim 2, further comprising:

supporting means, which supports the pattern roller and the inking device, and which can move in the axial direction of the pattern roller.

9. The intaglio printing press according to claim 8 wherein the supporting means includes an inker frame, which supports the pattern roller and the inking device, and which is provided with an engaging portion engaged with an engaging portion provided in a main body frame of the printing press.

10. The intaglio printing press according to claim 9 wherein the engaging portion of the inker frame is a guide rail, the engaged portion of the main body frame is a guide member supporting the guide rail in a manner that the guide rail can slidingly move, the guide rail and the guide member guide the inker frame in a manner that the inker frame can be moved between such a position inside the printing press that the pattern roller and the inking device are positioned inside the main body frame, and such a position outside the printing press that the pattern roller and the inking device are positioned outside the main body frame, and the inker frame is supported on the main body frame in a manner that the inker frame is spaced apart from a floor when being positioned inside the printing press, while the inker frame is supported on the floor due to a deflection of the guide rail when being positioned outside the printing press.

11. The intaglio printing press according to claim 1 wherein the printing surface switching means includes a convertible cylinder, which grips the back edge portion of the sheet transported from the first intaglio printing unit with the forward edge portion of the sheet being held so as to transfer the sheet while turning over the sheet, and which alternatively grips the forward edge portion of the sheet transported from the first intaglio printing unit with the forward edge portion of the sheet being held so as to transfer the sheet while not turning over the sheet.

12. The intaglio printing press according to claim 11 wherein the printing surface switching means includes a transport cylinder, which is arranged upstream of the convertible cylinder in the transporting direction of the sheet in a manner that the transport cylinder faces the convertible cylinder, and which holds the forward edge portion of the sheet transported from the first intaglio printing unit so as to transfer the sheet to the convertible cylinder.

13. The intaglio printing press according to claim 12 wherein the transport cylinder is a suction cylinder.

14. The intaglio printing press according to claim 1 wherein the first drying means is arranged upstream, in the transporting direction of the sheet, of a portion where the printing surfaces are switched by the printing surface switching means.

15. The intaglio printing press according to claim 1 wherein the first intaglio printing unit includes said impression cylinder, which holds and transports the sheet, on which intaglio printing is performed on one of surfaces of the sheet held by the impression cylinder, and the first drying means is arranged to face the impression cylinder so that the first drying means can dry the one surface of the sheet transported by the impression cylinder of the first intaglio printing unit.

16. The intaglio printing press according to claim 1 wherein the first intaglio printing unit includes:

said impression cylinder, which holds the sheet; and said intaglio cylinder, which is in contact with the impression cylinder, and which performs printing on the sheet held by the impression cylinder, the intaglio printing press further comprises, transporting means, which grips the sheet on which printing is performed between the impression cylinder and the intaglio cylinder of the first intaglio printing unit so as to transport the sheet, and the first drying means is arranged to face the transporting means so that the first drying means can dry said surface of the sheet transported by the transporting means.

17. The intaglio printing press according to claim 1 wherein at least one of the first intaglio printing unit and the second intaglio printing unit is a gravure printing device.

18. The intaglio printing press according to claim 1 wherein one of the first intaglio printing unit and the second intaglio printing unit is a gravure printing device, and the other one of the first intaglio printing unit and the second intaglio printing unit is an intaglio printing device.

* * * * *